US009855193B2

(12) United States Patent
O'Doherty

(10) Patent No.: US 9,855,193 B2
(45) Date of Patent: Jan. 2, 2018

(54) REMINDER IDENTIFICATION ARTICLE

(71) Applicant: Porter John O'Doherty, Chandler, AZ (US)

(72) Inventor: Porter John O'Doherty, Chandler, AZ (US)

( * ) Notice: Subject to any disclaimer, the term of this patent is extended or adjusted under 35 U.S.C. 154(b) by 184 days.

(21) Appl. No.: 15/057,401

(22) Filed: Mar. 1, 2016

(65) Prior Publication Data

US 2017/0252268 A1 Sep. 7, 2017

(51) Int. Cl.
*A61J 7/04* (2006.01)

(52) U.S. Cl.
CPC ..... *A61J 7/04* (2013.01)

(58) Field of Classification Search
CPC ..... A61J 7/04; A61J 9/00
USPC ..... 116/308, 309, 310, 311, 312, 313, 314, 116/315, 316, 317, 318; 40/306, 310, 40/633
See application file for complete search history.

(56) References Cited

U.S. PATENT DOCUMENTS 97,669 A * 12/1869 McMillen ..... G09F 23/00 40/306
3,340,630 A * 9/1967 Becker ..... A44C 5/0015 40/107
3,574,957 A * 4/1971 Bello-Bridick .... A47G 19/2227 40/324
3,805,427 A * 4/1974 Epstein ..... G09F 3/005 283/900
3,996,879 A * 12/1976 Walton ..... A61J 7/04 116/308
4,557,215 A * 12/1985 Petersson ..... A63B 71/0672 116/222
4,713,900 A * 12/1987 Calloway, Jr. et al. .. G09F 3/00 40/310
4,802,438 A * 2/1989 DeJonge ..... A61J 7/04 116/308
4,860,684 A * 8/1989 Al-Harbi ..... A61J 7/04 116/308
4,877,119 A * 10/1989 Hosking ..... A47G 23/16 116/227

(Continued)

FOREIGN PATENT DOCUMENTS

CN 102715813 A * 10/2012 ..... A61J 7/04
CN 202490198 U * 10/2012 ..... A61J 9/00

*Primary Examiner* — R. A. Smith
(74) *Attorney, Agent, or Firm* — Iussa Law, PLLC

(57) ABSTRACT

A reminder identification article for a container comprises a pliable circumferential band comprising an inner and outer perimeter; indicia on the outer perimeter; a moveable indicia window to circumnavigate the band; and at least one pliable securing tab integrated at the inner perimeter that extends away from the inner perimeter to frictionally secure the container positioned within the inner perimeter. The band may comprise detent positions to facilitate discretely adjusting the position of the moveable indicia window, and such detent positions correspond to the various indicia markings; and a portion of the outer perimeter may receive identification markings. Other articles may comprise a first band at least partially encased by a second band, wherein the second band rotates about the first band and comprises a cutaway window to reveal indicia markings upon the first band. This other article may comprise the various features of the first article configuration.

19 Claims, 8 Drawing Sheets

(56) References Cited

U.S. PATENT DOCUMENTS

| | | | | | |
|---|---|---|---|---|---|
| 5,046,605 | A * | 9/1991 | Levrant | A45C 11/005 | 116/309 |
| 5,358,770 | A * | 10/1994 | Evans | B44C 5/00 | 40/310 |
| 5,482,163 | A * | 1/1996 | Hoffman | A61J 7/04 | 116/309 |
| 5,704,097 | A * | 1/1998 | Rahav | G09F 3/0352 | 24/16 PB |
| 5,845,777 | A * | 12/1998 | Najmi | A47G 23/16 | 116/227 |
| 6,802,279 | B1 * | 10/2004 | Johnson | G09F 11/23 | 116/306 |
| 6,805,072 | B1 * | 10/2004 | Desano | A61J 7/04 | 116/308 |
| 6,880,364 | B1 * | 4/2005 | Vidolin et al. | A44C 5/025 | 40/633 |
| 7,331,707 | B2 * | 2/2008 | DelValle et al. | A44C 5/0015 | 116/308 |
| 7,857,134 | B2 * | 12/2010 | Koch | A61J 7/04 | 206/459.1 |
| 8,136,687 | B2 * | 3/2012 | Wu | A61J 1/03 | 215/206 |
| 9,003,999 | B2 * | 4/2015 | Bischoff et al. | A47G 23/16 | 116/309 |
| 2003/0192468 | A1 * | 10/2003 | Goertzen | G09F 11/23 | 116/309 |
| 2010/0101124 | A1 * | 4/2010 | Sorensen | G09F 3/04 | 40/306 |

* cited by examiner

REMINDER IDENTIFICATION ARTICLE

BACKGROUND OF THE INVENTION

It is estimated that nearly half of the population relies upon some type of medication that has to be administered at regular intervals. Many of these medications are health critical for a user. The failure to ingest their medication, ingesting the wrong medicine, as well as accidentally doubling-up, overdosing, etc., can result in, including but not limited to, continued illness, failure to cure, suppressing medicinal effectiveness, inducing side effects, or even causing death. The problem is even more attenuated if a patient relies upon a third party to mete out their medicine, which may include multiple other third parties whom may easily fail to act or miscommunicate.

In an attempt to alleviate the above hazards, many users rely upon mere memory, which can be clearly flawed, particularly if exacerbated by the medical condition itself, advanced age, etc. Other times users may attempt to rely upon various types of alarms, reminder gadgets, memory tricks, charts, signage, and even other third parties.

What is needed, and disclosed by this disclosure, is an effective and easy to use article that simplifies for a user or third party a manner to be reminded of the time and/or identification of a particular medicine that needs to be or has been accessed from a medicinal container. Moreover, what is needed and disclosed herein is such an article that may be easily adapted to accommodate a variety of medicine bottle shapes and sizes, and is easy to mark for identification and to manipulate any reminder elements. Other types of items and/or containers that may benefit by a reminder identification article may also employ that which is disclosed herein.

SUMMARY OF THE INVENTION

Among some exemplary embodiments, a reminder identification article may comprise a circumferential band comprising an inner perimeter and an outer perimeter; indicia upon the outer perimeter; at least one moveable indicia window to circumnavigate at least a portion of the circumferential band; and at least one securing tab integrated at the inner perimeter, wherein the at least one securing tab extends away from the inner perimeter.

Among the exemplary embodiments, some or all of them may comprise that the article further comprise that the at least one securing tab may deform to facilitate securing the article to a container, via a friction fit, as the container is positioned within the band's inner perimeter. Some or all of the exemplary embodiments may also comprise the moveable indicia window to circumnavigate at least a portion of the circumferential band at various detent positions of the circumferential band, and wherein the various detent positions correspond to indicia markings. Among most embodiments, the circumferential band and the securing tab(s) comprise of a pliable material, and the securing tab may further operate to space the circumferential band a distance apart from the item to which the article is used so as to maintain the visibility of the item's underlying bottle or label print; and in a preferred embodiment, the article is configured to accommodate an item that is a medicine bottle. Moreover, some exemplary embodiments may comprise the outer perimeter of the circumferential band to comprise at least a portion to receive identification markings by at least one of a manufacturer, shipper, packager, supplier, distributor, retailer, and user.

Among other exemplary embodiments, a reminder identification article comprises: a circumferential first band; indicia upon an outer perimeter of the circumferential first band; a second band to at least partially encase the circumferential first band and is configured to rotate about the circumferential first band; a cutaway window at an outer perimeter of the second band to selectively reveal a portion of the indicia upon the outer perimeter of the circumferential first band; and at least one securing tab integrated at an inner perimeter of the second band, wherein the at least one securing tab extends away from the inner perimeter of the second band.

These other exemplary embodiments may further comprise some or all of the features with respect to the earlier discussed various exemplary embodiments, for example, the at least one securing tab may deform to secure, via a friction fit, the article to a container as the container is positioned within the inner perimeter of the second band. The second band may circumnavigate at least a portion of the circumferential first band at various detent positions of the circumferential first band, and wherein the various detent positions correspond to indicia markings. The circumferential first band, the second band and the at least one securing tab comprises of a pliable material, and the securing tab may further operate to space the second band a distance apart from the item to which the article is used so as to maintain the visibility of the item's underlying bottle or label print; and in a preferred embodiment, the article is configured to accommodate an item that is a medicine bottle The outer perimeter of the second band may also comprise at least a portion to receive identification markings by at least one of a manufacturer, shipper, packager, supplier, distributor, retailer, and user.

BRIEF DESCRIPTION OF THE DRAWINGS

A more complete understanding of a reminder identification article may be derived by referring to the detailed description and claims when considered in connection with the following illustrative FIGS. In the following FIGS., like reference numbers refer to similar elements and steps throughout the FIGS.

Elements in the FIGS. are illustrated for simplicity and clarity and have not necessarily been rendered according to any particular configuration. For example, elements shown may be constructed and/or assembled concurrently or in different order or embodiments, and are illustrated in the FIGS. to help to improve an understanding of exemplary embodiments of the reminder identification article.

DETAILED DESCRIPTION OF THE INVENTION

A reminder identification article may be described herein in terms of various functional components and such functional components may be realized by any number of hardware components to perform specified functions and achieve various results. For example, the reminder identification article may employ various reminder identification elements, such as bands, clips, bracelets, indicia, moveable windows, securing tabs, spacers, and the like, which all may carry out a variety of functions. In addition, the reminder identification article may be practiced in conjunction with any number of manners for reminding of and identifying various medicines; and the exemplary articles described are merely exemplary applications for the reminder identification article. Further, the reminder identification article may employ any number of conventional techniques for providing such a reminder identification article and/or assembling it into a desired configuration to operate as an article to remind and/or identify for a user, third party, and the like the identification of a particular medicine within a medicine bottle and/or times/dates of access, use or next access or next use for the medicine.

Figure 1:
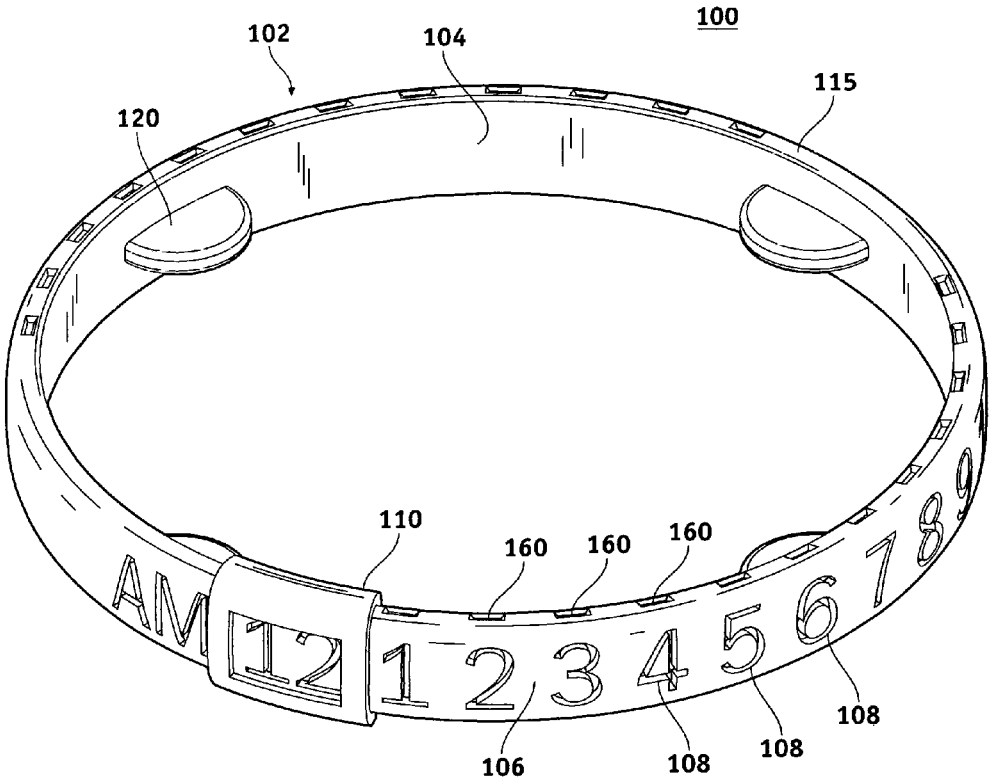
FIG. 1 representatively illustrates an exemplary embodiment of a reminder identification article.

Various exemplary embodiments of the reminder identification article may be applied to any item that may benefit from being identified or reminded for use. Referring now to FIG. 1, a reminder identification article 100 comprises, among some exemplary embodiments, a circumferential band 102 comprising an inner perimeter 104 and an outer perimeter 106. Article 100 also comprises indicia, exemplified by indicia markings 108, upon outer perimeter 106; at least one moveable indicia window 110 to circumnavigate at least a portion of circumferential band 102; and article 100 comprises at least one securing tab, exemplified by securing tab 120, integrated at inner perimeter 104, wherein at least one securing tab 120 extends away from inner perimeter 104 and, in most embodiments, at a direction towards a center of article 100 as well as normal to inner perimeter 104's surface. Among various exemplary embodiments, at least one securing tab 120 may further operate to space circumferential band 102 a distance apart from the item to which the article is used, which is discussed in greater detail below.

Figure 2:
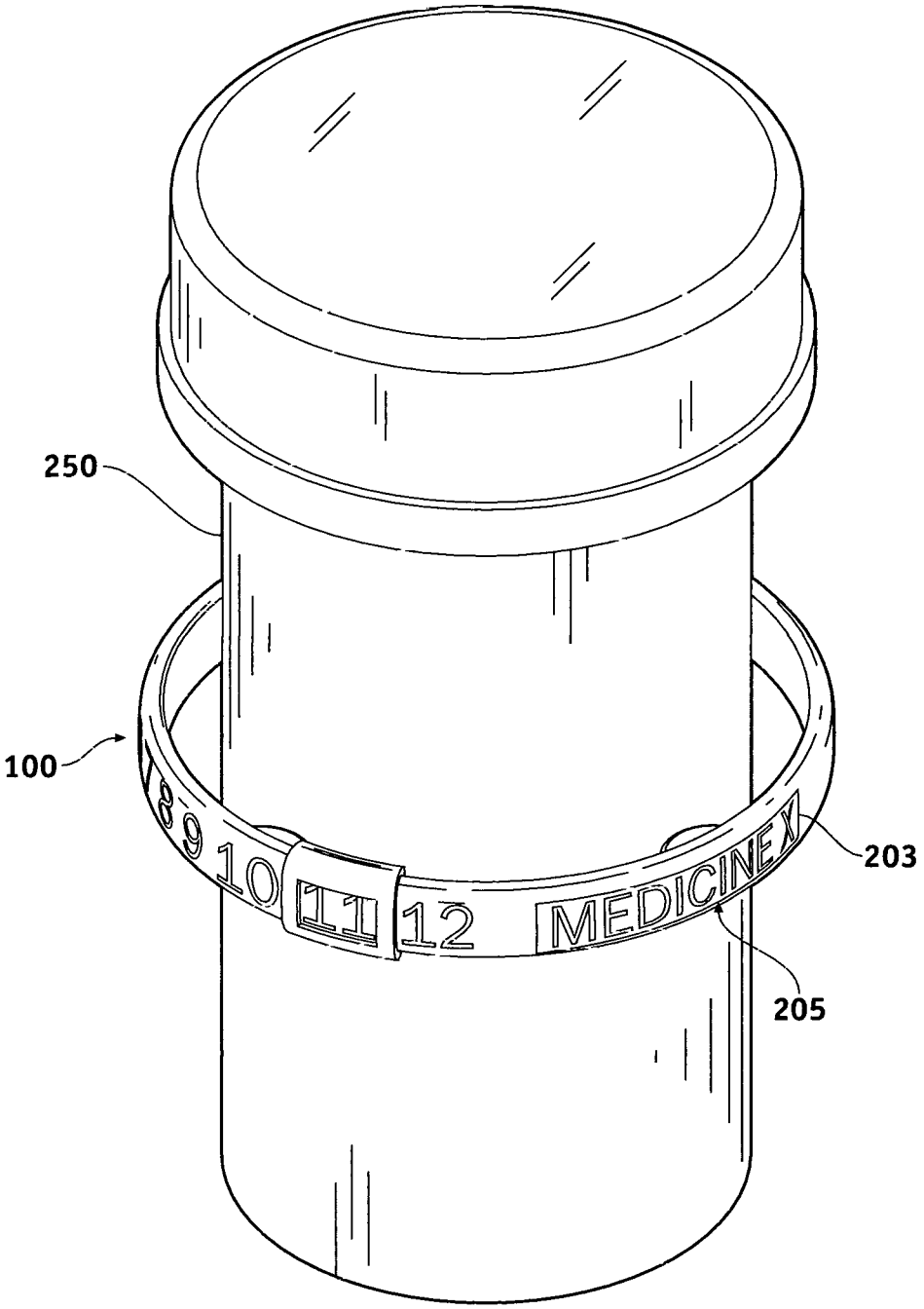
FIG. 2 representatively illustrates the reminder identification article affixed to a container.

Among the exemplary embodiments, article 100 may further comprise that the at least one securing tab 120 may deform, at least partially, to secure, via a friction fit, article 100 to an item, such as container 250, FIG. 2, when the container is positioned within inner perimeter 104. Returning to FIG. 1, some or all of the exemplary embodiments may also comprise moveable indicia window 110 to circumnavigate at least a portion of circumferential band 102, and in most exemplary embodiments window 110 may circumnavigate circumferential band 102 at various detent positions, such as exemplary detent positions 160 of circumferential band 102. In a preferred embodiment, the various detent positions correspond to indicia markings, such as indicia markings 108. Among most embodiments, circumferential band 102 and securing tab 120 comprise of a pliable material. In a preferred embodiment, article 100 is configured to accommodate a container that is a medicine bottle. Moreover, some exemplary embodiments may comprise outer perimeter 106 of circumferential band 102 to comprise at least a portion, such as portion 203 (FIG. 2), to receive identification markings, for example medicine type markings 205 (FIG. 2), by at least one of a manufacturer, shipper, packager, supplier, distributor, retailer, and user.

Figure 3:
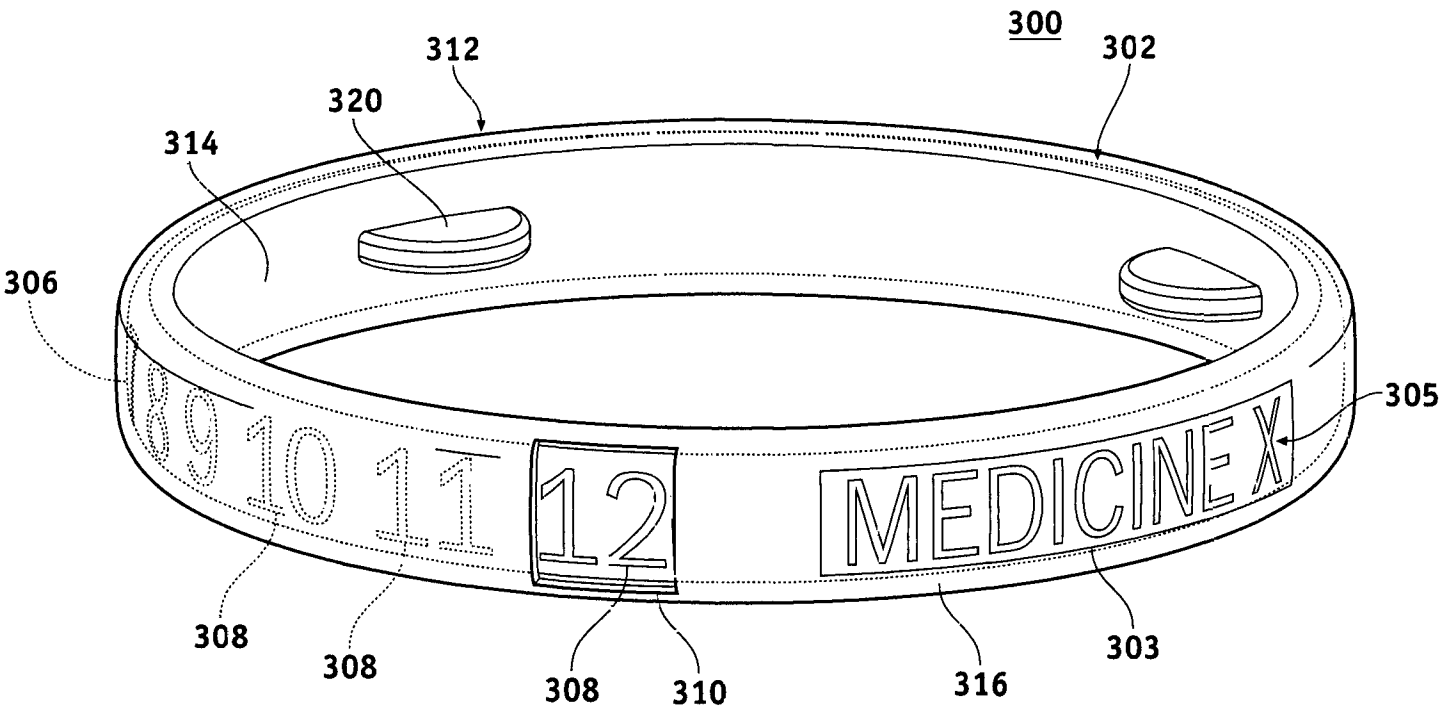
FIG. 3 representatively illustrates another exemplary embodiment of a reminder identification article.

Among other exemplary embodiments, and with reference to FIG. 3 a reminder identification article 300 comprises: a circumferential first band 302; indicia 308 upon an outer perimeter 306 of circumferential first band 302; a second band 312 that at least partially encases circumferential first band 302 and is configured to rotate about circumferential first band 302. This exemplary embodiment may comprise a cutaway window 310 at an outer perimeter 316 of second band 312 to selectively reveal a portion of indicia 308 upon outer perimeter 306 of circumferential first band 302; and at least one securing tab 320 integrated at an inner perimeter 314 of second band 312, wherein at least one securing tab 320 extends away from inner perimeter 314 of second band 312, and, in most embodiments, at a direction towards a center of article 300 as well as normal to inner perimeter 314's surface. Among various exemplary embodiments, at least one securing tab 320 may further operate to space second band 312 a distance apart from the item to which the article is used.

The exemplary embodiment of article 300 may further comprise some or all of the features with respect to the earlier discussed exemplary embodiment of article 100, for example, the at least one securing tab 320 may at least partially deform to secure, via a friction fit, article 300 to an item, similar in manner that article 100 secures to container 250 of FIG. 2, when the container is positioned within inner perimeter 314 of second band 312. Second band 312 may circumnavigate at least a portion of circumferential first band 302, and among most exemplary embodiments second band 312 may circumnavigate circumferential first band 302 at various detent positions of circumferential first band 302, similar to article 100's detent positions 160 of FIG. 1, and wherein the various detent positions correspond to indicia markings, such as indicia markings 308. Circumferential first band 302, second band 312 and at least one securing tab 320 comprise of a pliable material. Container, such as container 250, may comprise a medicine bottle. And outer perimeter 316 of second band 312 may also comprise at least a portion, such as portion 303, to receive identification markings, such as medicine type markings 305, by at least one of a manufacturer, shipper, packager, supplier, distributor, retailer, and user.

Among the various exemplary embodiments disclosed herein, article 100 comprises a circumferential band, such as circumferential band 102 (FIG. 1) and bands 302 and 312 (FIG. 3). While the preferred embodiments comprise bands that are circumferential (circular) to accommodate typical medicine bottles known in the art, those skilled in the art will appreciate that various other band embodiments may comprise any regular or irregular geometric configuration. For example, the various band embodiments may comprise an oval shape, hexagonal, octagonal, pentagonal, square, triangular, etc. These other shape configurations are contemplated by this disclosure because those skilled in the art will appreciate that the items to which the article may used, may sometimes comprise of other regular or irregular geometric shapes as well. Thus, any articles disclosed herein may be configured to accommodate such other item geometric configurations; and the various other elements disclosed herein with respect to a circumferential band embodiment may be configured to operate so as to accommodate any other regular or irregular geometric shape item configuration.

Among the various exemplary embodiments, article 100 and/or article 300 comprise indicia, such as indicia markings 108 (FIG. 1) and indicia markings 308 (FIG. 3). In a preferred embodiment, indicia markings comprise designations that correspond to particular times of the day, generally hours 1-12 or 1-24. It will be appreciated by those skilled in the art, though, that any of a variety of other indicia markings may be incorporated, either in lieu of the hour markings or in addition to the hour markings. For example, indicia markings may comprise markings that correspond to an AM/PM designation, partial hour markings, day markings, date markings, etc. Moreover, while the markings may comprise readable indicia, other embodiments may comprise indicia that are symbolic in nature. It will also be appreciated by those skilled in the art that the indicia markings may be raised, recessed, or embossed upon the respective bands. In one example, the indicia may be raised Braille to assist the visually impaired. Those skilled in the art will further appreciate that the indicia markings may also comprise of various font, color, size and positional placement upon the various band embodiments.

Among various exemplary embodiments, article 100 comprises moveable indicia window, such as moveable indicia window 110 to circumnavigate at least a portion of the circumferential band, such as band 102. In this manner, the indicia window can be positioned at any point about the band and, in a preferred embodiment, is positioned by a user to correspond to a particular indicia marking. In a preferred embodiment, a reminder identification article may comprise a single moveable indicia window, but other exemplary embodiments may comprise two or more moveable indicia windows to accommodate more than one indicia marking. For example, one moveable indicia window may move to correspond to a particular hour indicia marking while a second moveable indicia window may move to correspond to a particular AM or PM marking, partial hour marking, date marking, etc. Those skilled in the art will appreciate that one or more moveable indicia windows may be moveable to accommodate any single or combination of indicia markings. Moreover, while the moveable indicia windows disclosed, such as moveable indicia window 110, comprise a through put opening to view the underlying indicia markings, any other window configurations now known or developed in the future may be employed. For example, moveable indicia windows may comprise various size, color, and/or geometric configurations; multiple window openings; some may comprise closures to cover the window opening; yet others may comprise protective window coverings; positional locking mechanisms, etc. Some exemplary embodiments many even include a magnifying lens incorporated to the indicia windows or cutaway window openings discussed herein so as to provide visual amplification of any indicia. In a preferred exemplary embodiment moveable indicia window, such as window 110, is generally affixed in a permanent manner to a circumferential band, other exemplary embodiments, though, may comprise moveable indicia windows that are removable from the band, adjustable, or customizable in any variety of contemplated fashions.

Among various exemplary embodiments, and with reference to article 300 (FIG. 3), article 300 does not necessarily comprise a moveable indicia window, but rather comprises a cutaway window portion 310 at an outer perimeter 316 of second band 312. In this manner, portion 310 operates similarly as moveable indicia window 110 so as to reveal underlying indicia markings; in the case of article 300 the indicia markings that are recessed, raised and/or embossed upon encased, circumferential first band 302. While those skilled in the art will appreciate that article 300 operates in a somewhat different fashion than article 100, the object of the articles are the same; to provide identification and/or reminders for a user. It will be further appreciated by those skilled in the art that the various attributes discussed above with respect to moveable indicia window 110 of article 100 may likewise be employed in a respective manner by the cutaway window of article 300, such as, multiple cutaway windows, customizable cutaway windows, closeable cutaway windows, locking mechanisms, incorporated magnification lenses, etc.

Figure 4:
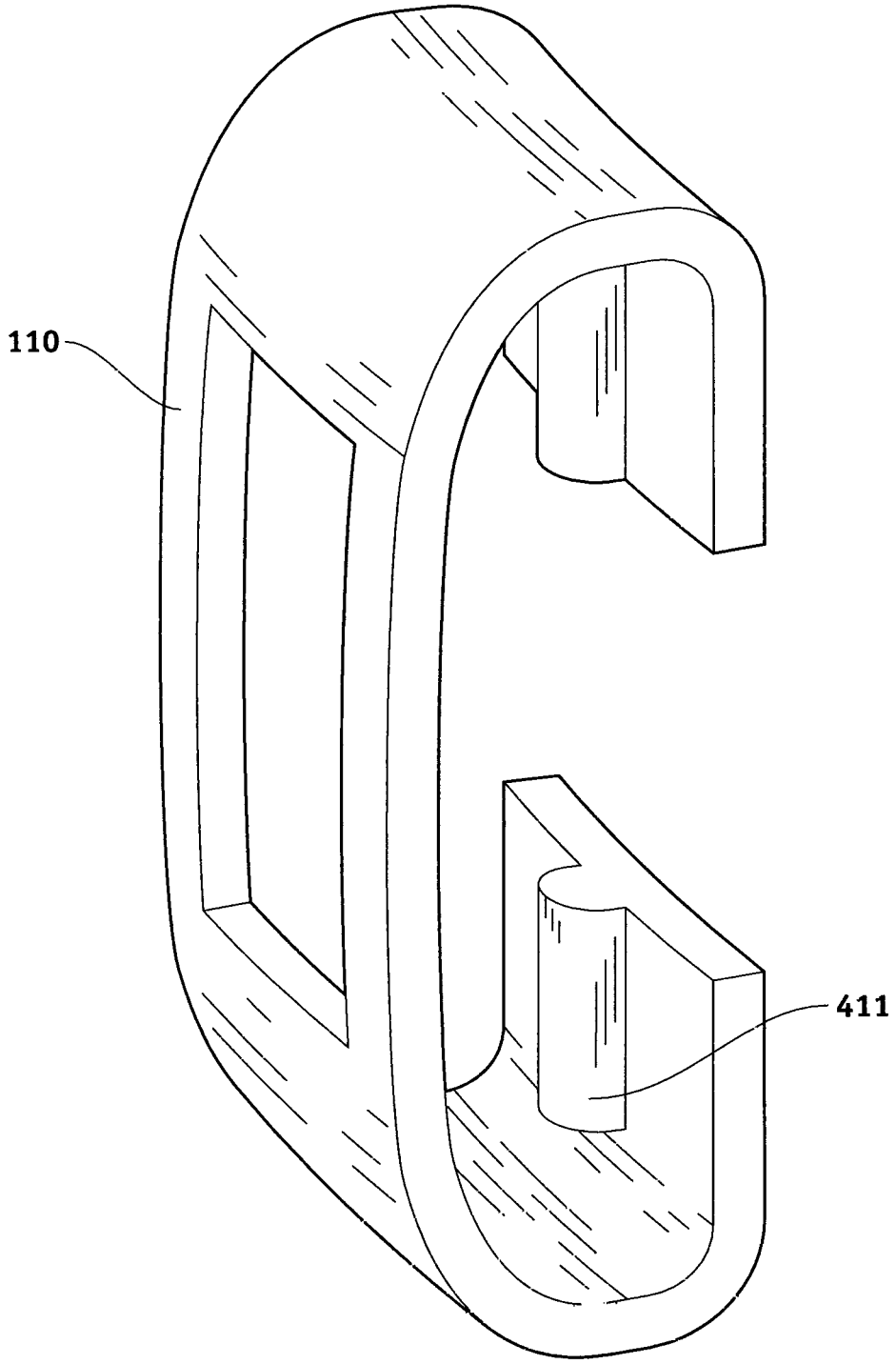
FIG. 4 representatively illustrates an exemplary embodiment of a moveable indicia window depicting a detent tab.
Figure 5:
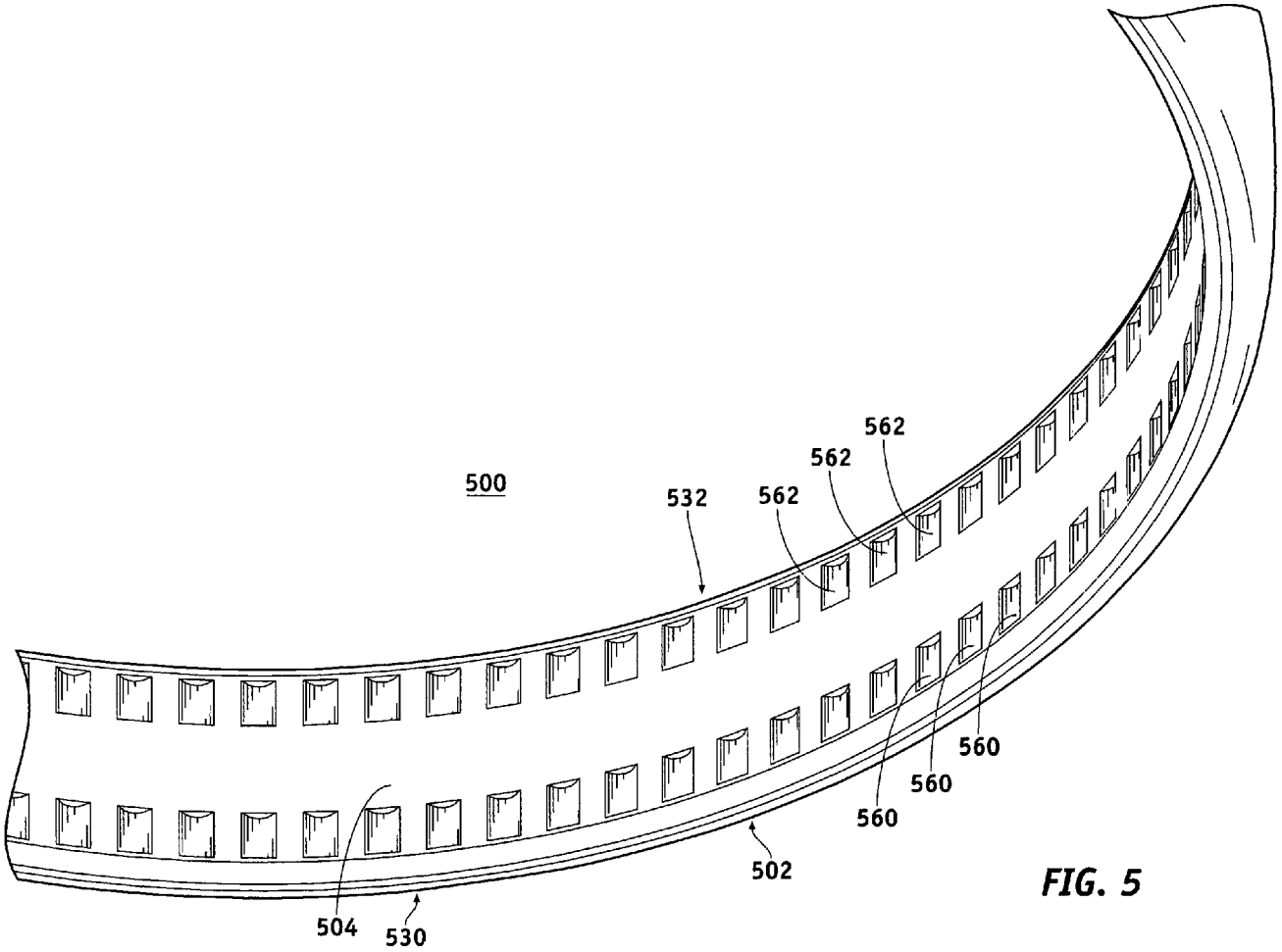
FIG. 5 representatively illustrates an exemplary embodiment of a circumferential band comprising detent positions at an inner perimeter of the band.

Among various exemplary embodiments, article 100 comprises moveable indicia window 110 and article 300 comprises second band 312 that encases and rotates about circumferential first band 302. It will be appreciated by those skilled in the art that the movement of indicia window 110 and second band 312 about first band 302 may do so in either a discrete or non-discrete manner. In a preferred embodiment, moveable indicia window 110 and second band 312 are moveable in a discrete, detent fashion. With reference to FIG. 4, moveable indicia window 110 comprises at least one detent tab, such as detent tab 411, integrated at an underside portion of window 110 such that as the user moves indicia window 110 about circumferential band 102, the tab nests within detent positions, such as detent positions 160 (FIG. 1). In this manner, moveable indicia window 110 is partially secured from any accidental or unwanted movement. In one exemplary embodiment and with reference to FIG. 1, detent positions 160 may be placed along a topside 115 of circumferential band 102 between inner perimeter 104 and outer perimeter 106. In another embodiment, though, detent positions may be placed along a bottom side (not shown) of circumferential band 102; or at both of a topside 115 and bottom side of circumferential band 102. In yet another exemplary embodiment, rather than detent positions integrated at the topside and/or bottom side of the circumferential band, detents may be positioned along a top and/or bottom portion of the inner perimeter of the circumferential band. For example, and with reference to FIG. 5, detent positions 560 and 562 depict the detent positions along a respective bottom portion 530 and upper portion 532 at an inner perimeter 504 of a circumferential band 502 of an article 500. It will be appreciated by those skilled in the art that while these detent tabs and positions are one manner to secure any unwanted or accidental movement of moveable indicia window 110, other mechanisms now known or developed in the future may be employed. It will be further appreciated by those skilled in the art that whole the detent tab of FIG. 4 comprises a "male" portion that nests within the "female" portion of the detents, such as those shown by detents 160 (FIG. 1) and detents 560 (FIG. 5), the male/female configurations may be reversed or otherwise configured.

It will be appreciated by those skilled in the art that the detent movement described above with respect to articles 100 and 500 may similarly be configured with respect to article 300 described herein. In this exemplary embodiment, circumferential first band 302 and second band 312, which at least partially encases first band 302, may similar comprise of any of a variety of configurations of detent positions and detent tabs so that as second band 312 rotates about first band 302 it may likewise be partially secured from accidental or unwanted movement.

Figure 6:
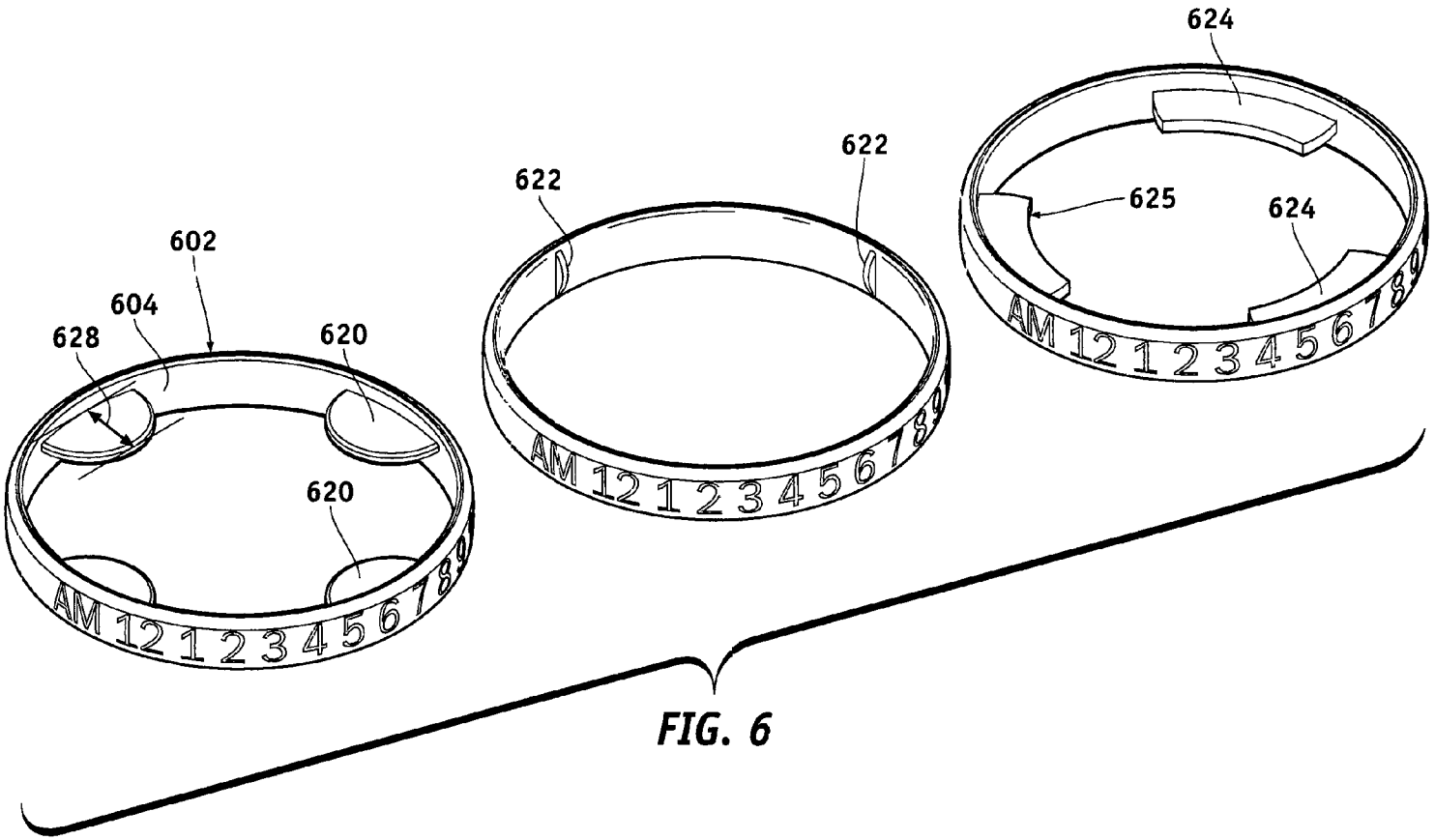
FIG. 6 representatively illustrates exemplary embodiments of reminder identification articles comprising various securing tabs.

Turning now to FIG. 6, a variety of circumferential bands are depicted that display various securing tab configurations that extend away from the inner perimeter of the band, such as those mentioned briefly earlier with respect to securing tabs 120 (FIG. 1). Moreover, those skilled in the art will easily appreciate that the securing tabs depicted by those shown in FIG. 6 may likewise be applicable to article 300

(FIG. 3). In one exemplary embodiment, securing tabs 620 comprise a planar, hemispherical tab configuration. In another exemplary embodiment, securing tabs 622 comprise protrusions that extend normal from a top side of the band along the wall of the inner perimeter to a bottom side of the band. And in still yet another exemplary embodiment, securing tables 624 comprise a planar tab configuration that further comprises a cutaway portion 625 at a distal end of each tab so as to more easily conform to a rounded item that the article may be used, for example as shown by the rounded medicine bottle 250 (FIG. 2). In a preferred embodiment, the various securing tabs disclosed may be pliable (flexible) so as to at least partially deform such that an item positioned within the band is secured by a friction fit of the securing tabs against a wall of the item, such as a medicine bottle wall. Those skilled in the art will appreciate that the securing tabs disclosed may comprise materials that deform to varying degrees. In most embodiments, the securing tabs comprise of the same material as the band and are integrally molded with the band, however, other configurations may comprise securing tabs that comprise other materials, different from the band material, and such securing tabs may be affixed to the band by any manner known in the art such as by glues, welds, and the like. In a unique fashion, the securing tabs, to varying degrees, may further operate to space the band portion apart from the item it may be used with so as to prevent the band portion from covering any desired information on the bottle or bottle label. Moreover, by having the band spaced apart it further allows for easier movement and/or adjustment of any moveable indicia window circumferentially about the band. For example, with respect to securing tabs 620, as an item may be positioned and secured, in similar fashion as shown by container 250 secured to article 100 at FIG. 2, an inner perimeter 604 of circumferential band 602 may be distanced from the item a distance 628, circumferentially about the item.

Among various exemplary embodiments, such as the various articles disclosed herein, The outer perimeter of the band such as outer perimeter 106 of article 100 or outer perimeter 306 of article 300 may comprise at least one identifying portion, such as respective identifying portions 203 of article 100 and identifying portion 303 of article 300 to receive identification markings by at least one of a manufacturer, shipper, packager, supplier, distributor, retailer, and user. In a preferred embodiment, the identifying portions comprise of a textured and/or writable surface so that markings, such as respective markings 205 of article 100 or markings 305 of article 300, may remain legible. In some exemplary embodiments the identifying portions provide for identifying markings to be permanent, but in other embodiments the identifying portions may be erasable and/or re-usable for multiple use as the articles are used, for example, on one type of medicine bottle and then re-used on a different type of medicine bottle. Those skilled in the art will appreciate that identifying portions may comprise of various types of sizes and configurations, and some articles may comprise multiple identifying portions.

Figure 7:
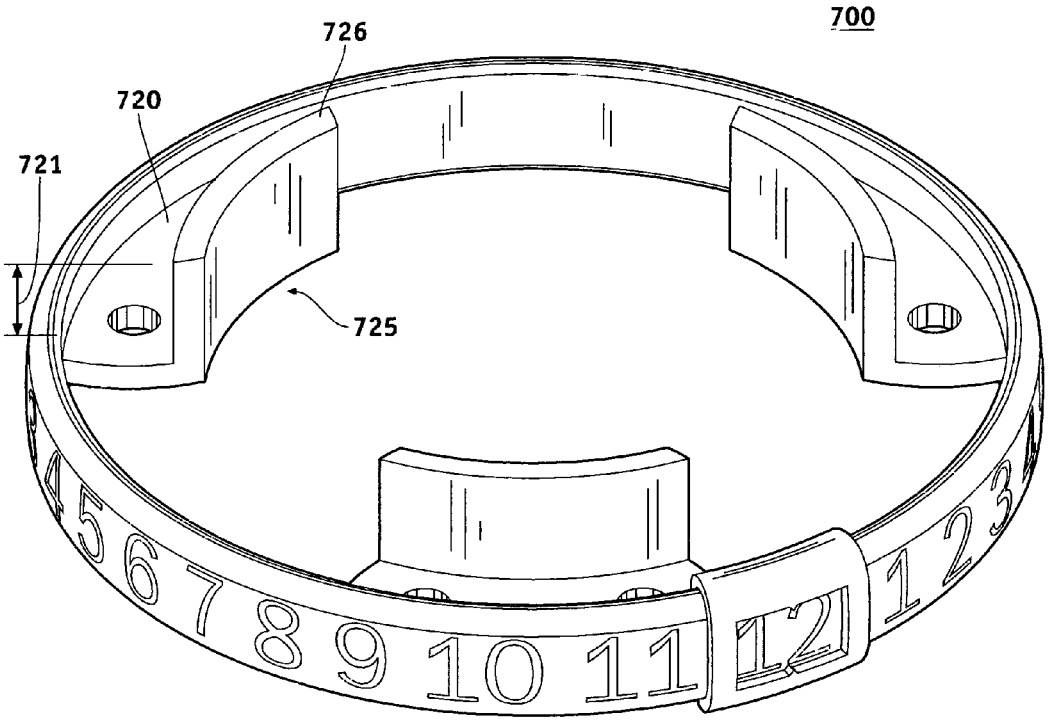
FIGS. 7 & 8 representatively illustrate exemplary embodiments of reminder identification articles comprising article stacking elements.
Figure 8:
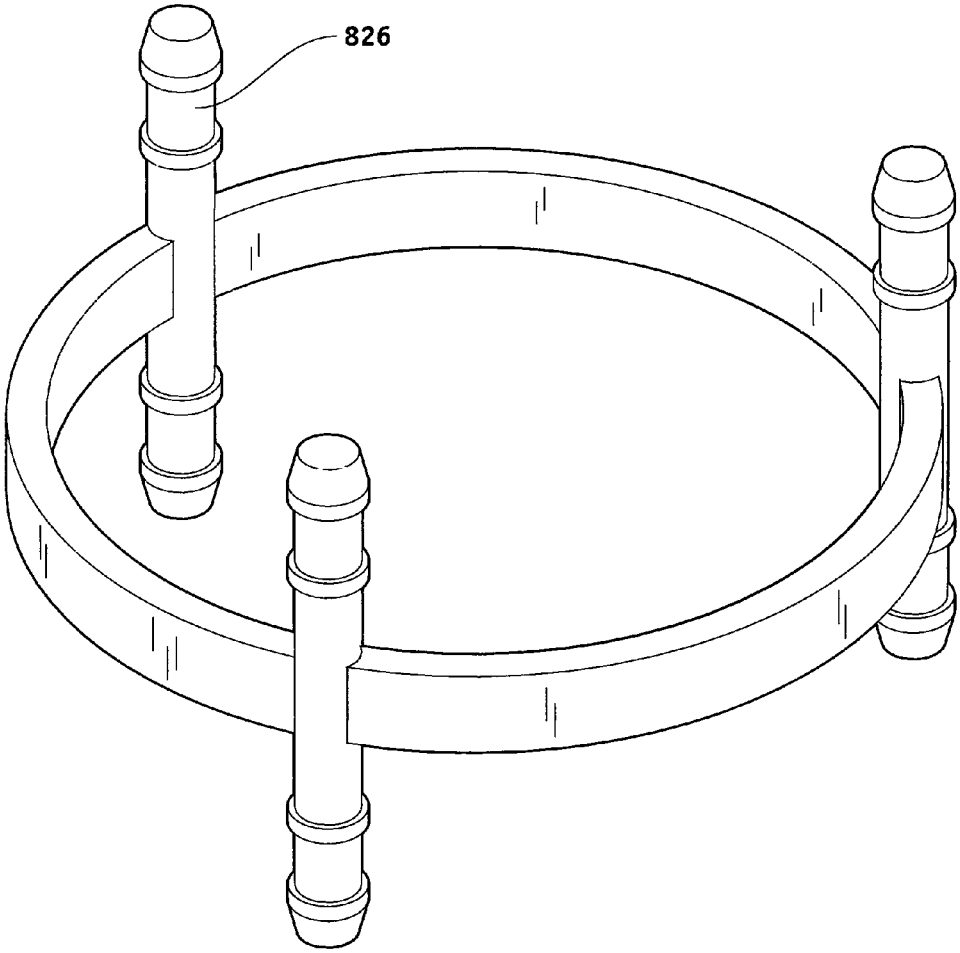

Turing now to FIGS. 7 and 8, exemplary embodiments of articles comprising band stacking elements are shown. For example, FIG. 7 comprises article 700 comprising tabs similar to other tabs discussed herein, but in this exemplary embodiment tabs, such as tab 720, further comprise band stacking elements, such as band stacking element 726, which may be affixed at a distal end, such as distal end 725, of tab 720. In one exemplary embodiment, band stacking element 726 extends in a normal direction to tab 720 by a distance 721. Those skilled in the art will appreciate that such band stacking elements allows a user to position one reminder identification article upon another and the band stacking elements operate to space such placed bands apart from one another. This configuration further allows for any indicia windows or rotatable bands to move freely without hindrance from any other bands positioned above or below it. FIG. 8 comprises an exemplary embodiment of a feature for an article, such as stacking pillars 826, that those skilled in the art will appreciate can similarly operate to space apart multiple adjacent articles, and which may be coupled to an inner perimeter of a band similarly as the various tabs disclosed herein.

In the foregoing specification, the reminder identification article has been described with reference to specific exemplary embodiments. Various modifications and changes may be made, however, without departing from the scope of the reminder identification article as set forth in the claims. The specification and FIGS. are illustrative, rather than restrictive, and modifications are intended to be included within the scope of the reminder identification article. Accordingly, the scope of the reminder identification article should be determined by the claims and their legal equivalents rather than by merely the examples described.

For example, the components and/or elements recited in any physical embodiment claims may be assembled or otherwise operationally configured in a variety of permutations and are accordingly not limited to the specific configuration recited in the claims.

Benefits, other advantages and solutions to problems have been described above with regard to particular embodiments; however, any benefit, advantage, solution to problem or any element that may cause any particular benefit, advantage or solution to occur or to become more pronounced are not to be construed as critical, required or essential features or components of any or all the claims.

As used herein, the terms "comprise", "comprises", "comprising", "having", "including", "includes" "is" or any variation thereof, are intended to reference a non-exclusive inclusion, such that a process, method, article, composition or apparatus that comprises a list of elements does not include only those elements recited, but may also include other elements not expressly listed or inherent to such process, method, article, composition or apparatus. Other combinations and/or modifications of the above-described structures, arrangements, applications, proportions, elements, materials or components used in the practice of the reminder identification article, in addition to those not specifically recited, may be varied or otherwise particularly adapted to specific environments, manufacturing specifications, design parameters or other operating requirements without departing from the general principles of the same.

The invention claimed is:

1. A reminder identification article comprises:

a circumferential band comprising an inner perimeter and an outer perimeter;

indicia upon the outer perimeter;

at least one moveable indicia window to circumnavigate at least a portion of the circumferential band; and at least one securing tab integrated at the inner perimeter, wherein the at least one securing tab extends away from the inner perimeter.

2. The article of claim 1, wherein the at least one securing tab may deform to secure, via a friction fit, the article to a container positioned within the inner perimeter.

3. The article of claim 2, wherein the moveable indicia window may circumnavigate the at least a portion of the circumferential band at detent positions of the circumferential band, and wherein the detent positions correspond to indicia markings.

4. The article of claim 3, wherein the circumferential band and the at least one securing tab comprises a pliable material.

5. The article of claim 4, wherein the container is a medicine bottle.

6. The article of claim 5, wherein the at least one securing tab spaces the circumferential band at least a distance from the medicine bottle.

7. The article of claim 6, wherein the outer perimeter of the circumferential band comprises at least a portion to receive identification markings by at least one of a manufacturer, shipper, packager, supplier, distributor, retailer, and user.

8. A method to manufacture a reminder identification article comprises:

molding a circumferential band comprising an inner perimeter and an outer perimeter;

affixing indicia upon the outer perimeter;

affixing at least one moveable indicia window to circumnavigate at least a portion of the circumferential band; and wherein molding the circumferential band further comprises integrally molding at least one securing tab at the inner perimeter, wherein the at least one securing tab extends away from the inner perimeter.

9. The method of claim 8, wherein the integrally molded at least one securing tab may deform to secure, via a friction fit, the article to a container positioned within the inner perimeter.

10. The method of claim 9, wherein the moveable indicia window may circumnavigate the at least a portion of the circumferential band at further molded detent positions of the circumferential band, and wherein the further molded detent positions correspond to indicia markings.

11. The method of claim 10, wherein the at least one securing tab spaces the circumferential band at least a distance from the medicine bottle.

12. The method of claim 11, comprises molding the circumferential band and the at least one securing tab from a pliable material.

13. A reminder identification article comprises:

a circumferential first band;

indicia upon an outer perimeter of the circumferential first band;

a second band to encase the circumferential first band and to rotate about the circumferential first band;

a cutaway window at an outer perimeter of the second band to selectively reveal a portion of the indicia upon the outer perimeter of the circumferential first band; and at least one securing tab integrated at an inner perimeter of the second band, wherein the at least one securing tab extends away from the inner perimeter of the second band.

14. The article of claim 13, wherein the at least one securing tab may deform to secure, via a friction fit, the article to a container positioned within the inner perimeter of the second band.

15. The article of claim 14, wherein the second band may circumnavigate at least a portion of the circumferential first band at detent positions of the circumferential first band, and wherein the detent positions correspond to indicia markings.

16. The article of claim 15, wherein the circumferential first band, the second band and the at least one securing tab comprises a pliable material.

17. The article of claim 16, wherein the container is a medicine bottle.

18. The article of claim 17, wherein the at least one securing tab spaces the second band at least a distance from the medicine bottle.

19. The article of claim 18, wherein the outer perimeter of the second band comprises at least a portion to receive identification markings by at least one of a manufacturer, shipper, packager, supplier, distributor, retailer, and user.

* * * * *